US012310460B2

(12) United States Patent
Hurd

(10) Patent No.: US 12,310,460 B2
(45) Date of Patent: May 27, 2025

(54) BUTTON COVER

(71) Applicant: BUTTON UPS LLC, Charlotte, NC (US)

(72) Inventor: Nicholas Hurd, Charlotte, NC (US)

(73) Assignee: BUTTON UPS LLC, Charlotte, NC (US)

( * ) Notice: Subject to any disclaimer, the term of this patent is extended or adjusted under 35 U.S.C. 154(b) by 58 days.

(21) Appl. No.: 18/552,886

(22) PCT Filed: Apr. 1, 2022

(86) PCT No.: PCT/US2022/023149
§ 371 (c)(1),
(2) Date: Sep. 27, 2023

(87) PCT Pub. No.: WO2022/212903
PCT Pub. Date: Oct. 6, 2022

(65) Prior Publication Data

US 2024/0188689 A1 Jun. 13, 2024

Related U.S. Application Data

(60) Provisional application No. 63/285,848, filed on Dec. 3, 2021, provisional application No. 63/170,361, filed on Apr. 2, 2021.

(51) Int. Cl.
*A44B 1/14* (2006.01)

(52) U.S. Cl.
CPC ..... *A44B 1/14* (2013.01)

(58) Field of Classification Search
CPC ..... A44B 1/14
See application file for complete search history.

(56) References Cited

U.S. PATENT DOCUMENTS

| | | | | | |
|---|---|---|---|---|---|
| 338,111 | A * | 3/1886 | Smith | A44B 1/14 | 24/113 MP |
| 342,514 | A * | 5/1886 | Hormann | A44B 1/14 | 24/113 R |
| 2,906,045 | A * | 9/1959 | Stein | A44B 1/14 | 24/113 MP |
| 3,777,336 | A * | 12/1973 | Anderson | A44B 1/14 | 451/448 |
| 2008/0244873 | A1* | 10/2008 | Yamashita | A44B 1/04 | 24/90.1 |
| 2014/0101896 | A1* | 4/2014 | Rowton | A44B 1/14 | 24/113 MP |
| 2014/0109346 | A1 | 4/2014 | Barce et al. | | |
| 2017/0347756 | A1 | 12/2017 | Chen | | |
| 2019/0246724 | A1 | 8/2019 | Adams | | |

FOREIGN PATENT DOCUMENTS

| | | | |
|---|---|---|---|
| DE | 202005015545 | U1 | 2/2006 |
| EP | 2893828 | A2 | 7/2015 |

OTHER PUBLICATIONS

International Search Report and Written Opinion from corresponding International PCT Application No. PCT/US2022/023149, mailed Jul. 12, 2022.

* cited by examiner

*Primary Examiner* — David M Upchurch
(74) *Attorney, Agent, or Firm* — Greenberg Traurig, LLP

(57) ABSTRACT

Button covers which provide users the ability to customize their wardrobe are provided herein. The button cover fits over buttons to attached to an article such as clothing to accommodate the button in manner affording increased customization to the article for a user.

17 Claims, 13 Drawing Sheets

BUTTON COVER

CROSS-REFERENCE TO RELATED APPLICATIONS

The present application is the U.S. national phase application, pursuant to 35 U.S.C. § 371, of PCT international application Ser. No.: PCT/US2022/023149, filed Apr. 1, 2022, designating the United States and published in English, which claims priority to U.S. App. No. 63/170,361, filed Apr. 2, 2021 and U.S. App. No. 63/285,848, filed Dec. 3, 2021, each of which are hereby incorporated by reference in their entirety.

FIELD OF DISCLOSURE

The present disclosure is related to the field of button covers that provide users the ability to customize their wardrobe. More specifically, unobtrusive button covers that are both easily interchangeable due to the fast application design and widely available based on the production method.

BACKGROUND

Many people seek to express their individuality and create a unique brand for themselves based on the clothing and accessories they wear. While there are many possibilities for those wishing to customize their style each day, there are several major barriers preventing the wide adoption of many of these options. Examples of major barriers that exist include cost, availability, ease of application, and suitability. Unique clothing and accessories are often too expensive for the average person to incorporate into their daily wear. Many fashion innovations that provide a custom look cannot be easily mass produced to be made available to the general public. There are also a number of clothing items or accessories that take too long to apply. The application of these items or accessories does not fit into the average person's routine as they prepare for their day or an event. Further, many clothing items or accessories cannot be immediately incorporated into a person's wardrobe without additional manipulation of existing pieces. Finally, dress codes that exist in many environments, particularly in the workplace, may limit the suitability of options fashion seekers may otherwise have.

An example of an existing clothing accessory that enables the user's goal of creating a personal brand through wardrobe customization but has not yet been innovated to overcome the major barriers to adoption is the button cover. The opportunity exists to provide the general public another means of wardrobe customization with interchangeable button covers that are produced and function in a way that overcomes the aforementioned major barriers to adoption. Some attempts have been made to provide button covers, but these often have a multitude of issues including an inability to fully customize buttons, an inability to fully cover the button, substantially changing the appearance of the garment with unnecessary additions to the bulk of the button, and complicated fastening mechanisms.

SUMMARY

In accordance with the foregoing objectives and others, the present disclosure provides a button cover that removably attaches to and materially encloses an existing button on a garment or other item without adding substantial bulk.

For example, button covers of the present disclosure, adapted to cover a typically cylindrical button, may be characterized as increasing the height and/or diameter of the button by less than 20% or less than 10% or less than 5% (e.g., the ratio of the height of the button cover to the height of the button it is designed to accommodate is from 0.9-1.2 or from 1-1.2 or from 0.9-1.1 or from 1-1.1 or from 1-1.05, the ratio of the diameter of the button cover to the diameter of the button it is designed to accommodate is from 0.9-1.2 or from 1-1.2 or from 0.9-1.1 or from 1-1.1 or from 1-1.05). Features of the button cover described herein enable an expandable bottom opening for easy application and removal of the button cover to and from the button.

The button cover may be designed to be produced by a simple, cost-effective production method. In some embodiments, the button cover is a unitary part composed of one or more plastics. The button cover may be manufactured via a plastic molding process where the mold features a single cavity per instance.

In some embodiments, the button cover may comprise:

- a top cover of minimal thickness and/or width (e.g., with exterior face having a surface area greater than that of the button) with respect to the button;
- a bottom opening (e.g. circular bottom opening) having dimensions that permit to be inserted through in order to attach the button: wherein the bottom opening is formed from an annular wall extending from the perimeter of the bottom face of the cover;

wherein when the button cover is not attached to a button, the annular wall slants inward from the perimeter of the top face (e.g., at a degree less than 90 degrees with respect to the top cover); and when the button cover is attached to a button, the wall exerts a force (e.g., a frictional force) on the enclosed button (e.g., in order to contact the enclosed button during application to aid the sustained attachment of the cover and allow attachment to buttons of varied sizes);

wherein the wall comprises:

a) two or more slits disposed radially around the wall configured to allow the bottom opening to expand upon insertion of the button (e.g., from pushing the button cover over a button during application, pinching the top face during removal of the button cover);

b) two or more bottom snaps (e.g., trapezoidal, trigonal) extending from the bottom of the wall and inward towards the major axis of the button cover.

The annular walls and top cover may define a cavity for the button to be inserted into. The snap or any snap section may comprise at least two linear cross sectional surfaces (e.g., planar surfaces), wherein one surface forms an external face oriented away from the internal button cavity and the other surface forms the internal face oriented towards the internal button cavity. In some embodiments, the external face of the two or more snaps (or any snap section) comprise an inwardly sloped face (e.g., the slope of the bottom portion of the snap may be angled towards the top cover in the dimension towards the longitudinal axis of the cover) such that a force applied from the button to the snaps (e.g., the force during insertion of the button into the cover) causes the annular perimeter wall to move outward and separate at the slits. Following enough force and when the inner most periphery of the snaps is greater than the periphery of the button, the button may be inserted into a cavity formed by the top carver and wall such that the bottom face of the cover is in contact with the top face of the button and the walls are oriented against the inserted button to provide the force on the inserted button.

The interior face of any snap section oriented towards the internal button cavity may also be angled to accommodate certain functionality of the button covers. For example, the interior face of the snap is angled at obtuse angles with respect to the annular wall. These implementations may allow for an easier release of a button inserted into the cavity. In some embodiments, the interior face of the snap has a right or obtuse angle with a plane perpendicular to the inner surface of the top cover.

The snaps may extend around the periphery of the annular wall. In various implementations, the snaps do not extend around the periphery of the annular wall. For example, the snap may be formed only in some sections separated by each slit (e.g., alternating sections of the annular wall). In sections without a snap, the wall height may be independently selected from the wall height of the sections with a snap. For example, the wall height of the annular wall in sections without the snap may be less than or equal to the interior annular wall height of the sections with the snap.

In particular implementations, the button cover comprises an even number of slits (e.g., four, six, eight), wherein the annular wall between any two adjacent slits may independently comprise a snap or not comprise a snap. In particular implementations, the button cover comprises four slits to define four annular wall sections, wherein at least two annular wall sections comprise snaps (e.g., the annular wall sections on opposite sides of the button cover). In some embodiments, the button cover comprises four slits to define four annular wall sections, wherein two annular wall sections comprise snaps (e.g., the annular wall sections on opposite sides of the button cover) and two annular wall sections do not comprise snaps.

Various configurations of the button covers may comprise fillets, particularly internal fillets at specific positions with high stress concentration where corners (e.g., the corner between the annular wall and the top surface, the corner of the slits, the corners of the bottom of the annular wall) are rounded. For example, the button cover may comprise a fillet between the annular wall and the top cover. In some embodiments, the button cover comprises a fillet between the annular wall sections and the top cover between two slits comprising a snap section. The button cover may comprise fillets along the annular wall and slits.

Also provided herein is an apparatus for attaching to a piece of fabric comprising a button and a button cover, wherein the button cover is configured to removably attach to the button and the button cover comprises:

a top cover of minimal thickness and/or width (e.g., with exterior face having a surface area greater than that of the button) with respect to the button;

a bottom opening (e.g. circular bottom opening) having dimensions that permit to be inserted through in order to attach the button: wherein the bottom opening is formed from an annular wall extending from the perimeter of the bottom face of the button cover;

wherein when the button cover is not attached to a button, the annular wall slants inward from the perimeter of the top face (e.g., at a degree less than 90 degrees); and when the button cover is attached to a button, the wall exerts a force (e.g., a frictional force) on the enclosed button (e.g., in order to contact the enclosed button during application to aid the sustained attachment of the cover and allow attachment to buttons of varied sizes);

wherein the wall comprises:

a) two or more slits disposed radially around the wall configured to allow the bottom opening to expand upon insertion of the button (e.g., from pushing the button cover over a button during application or pinching the top face during removal of the button cover, among other actions);

b) two or more bottom snaps (e.g., trapezoidal, trigonal) extending from the bottom of the wall and inward towards the major axis of the button cover: wherein the two or more snaps comprises an inwardly sloped face on the surface oriented away from the internal cavity: such that the outermost peripheral of all of the sloped faces is dimensioned to provide an initial touch point for the button cover during application to a button;

wherein a force applied from the button to the snaps during application of the button causes the walls to separate at the slits, and when the inner most periphery of the snaps is greater than the periphery of the button, the button may be inserted such that the bottom face of the cover is in contact with the top face of the button and the walls are oriented against the inserted button to provide the force on the inserted button.

Methods are also provided for application and use of these button covers. The method may comprise a user to hold a button cover as used herein over a button and to apply a force towards the button such that the button cover is attached thereon. In some embodiments, the user may hold the button cover between their thumb and a finger and push the button cover in the direction of application. Such application may result in the annular perimeter wall of the button cover separating (e.g., spreading away from the major longitudinal axis of the cover) at the slits in order to allow the button to be inserted into the button cavity formed between the annular walls and the top cover.

BRIEF DESCRIPTION OF FIGURES

FIG. 9A is a perspective view of the button cover, FIG. 9B is a cross sectional view of the button cover, and FIG. 9C is an exterior side view of the button cover.

DETAILED DESCRIPTION

Detailed embodiments of the present disclosure are disclosed herein; however, it is to be understood that the disclosed embodiments are merely illustrative of the disclosure that may be embodied in various forms. In addition, each of the examples given in connection with the various embodiments of the disclosure is intended to be illustrative, and not restrictive.

All terms used herein are intended to have their ordinary meaning in the art unless otherwise provided.

As used herein, "a" or "an" shall mean one or more. As used herein when used in conjunction with the word "comprising," the words "a" or "an" mean one or more than one. As used herein "another" means at least a second or more.

The presently disclosed button covers typically "materially" enclose a button such that they cover all surfaces of the button aside from the button surface oriented towards the garment. A button, "materially enclosed" by a button cover as disclosed herein is typically not visible if attached to a garment.

When the button covers of the present "accommodate" a button, it is meant that the dimensions of the internal cavity are dimensioned such that the appropriate forces may be applied to secure and maintain the button cover around the accommodated button.

A button cover may not offer "substantial bulk" to an accommodated button such that when the button cover is accommodating a button, it may mimic the shape and size of the button and adding a slight if any perceived volume to each button. For example, a button cover, when accommodating a button, may be an increase in any of the dimensions of the button cover as compared to the button (e.g., height, width, diameter), independently, by no more than 20% (or from 1% to 20% or from 1% to 10% or from 1% to 5%).

Figure 1:
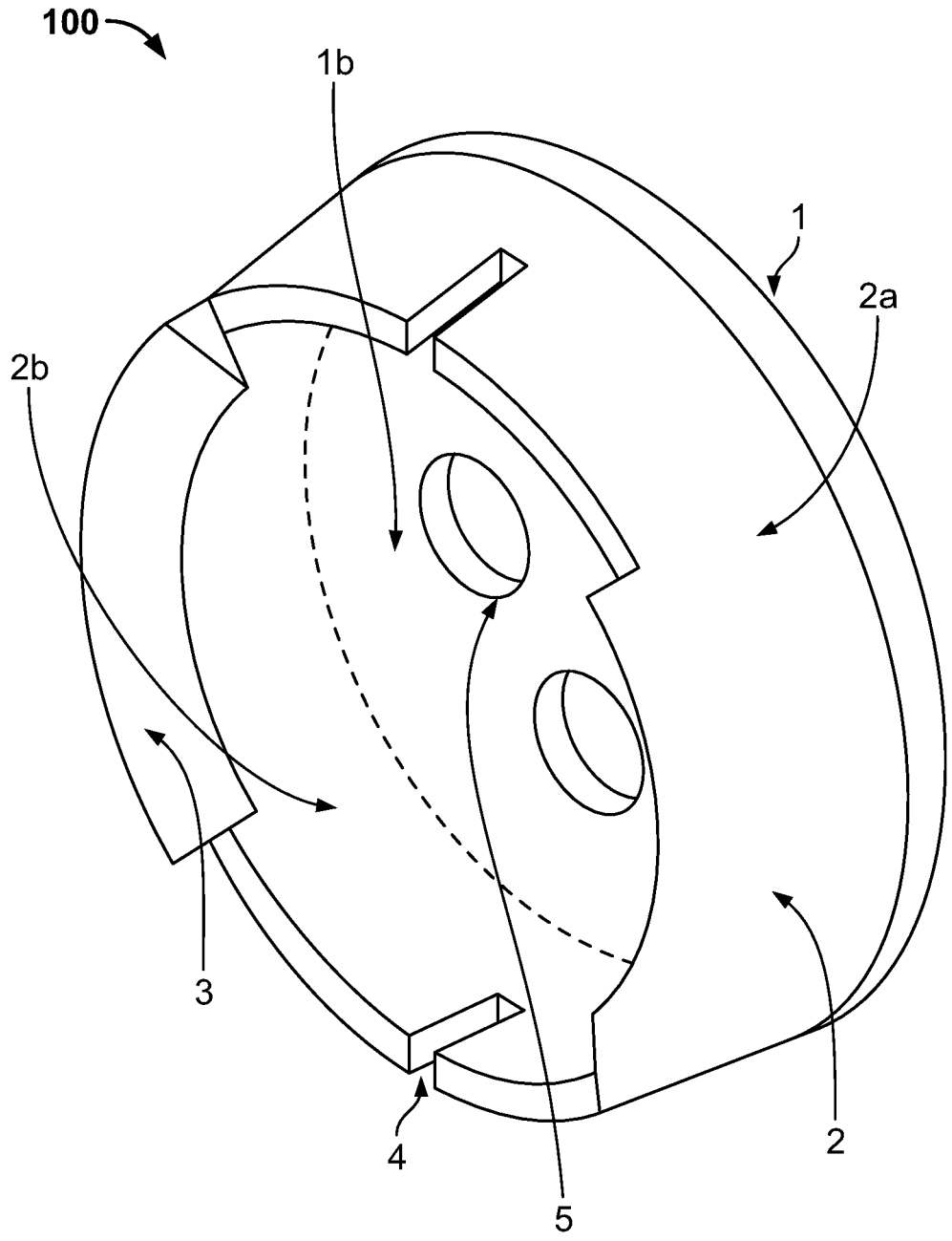
FIG. 1 is an isometric view illustrating a button cover of the present disclosure from the bottom prior to insertion of a button.
Figure 2:
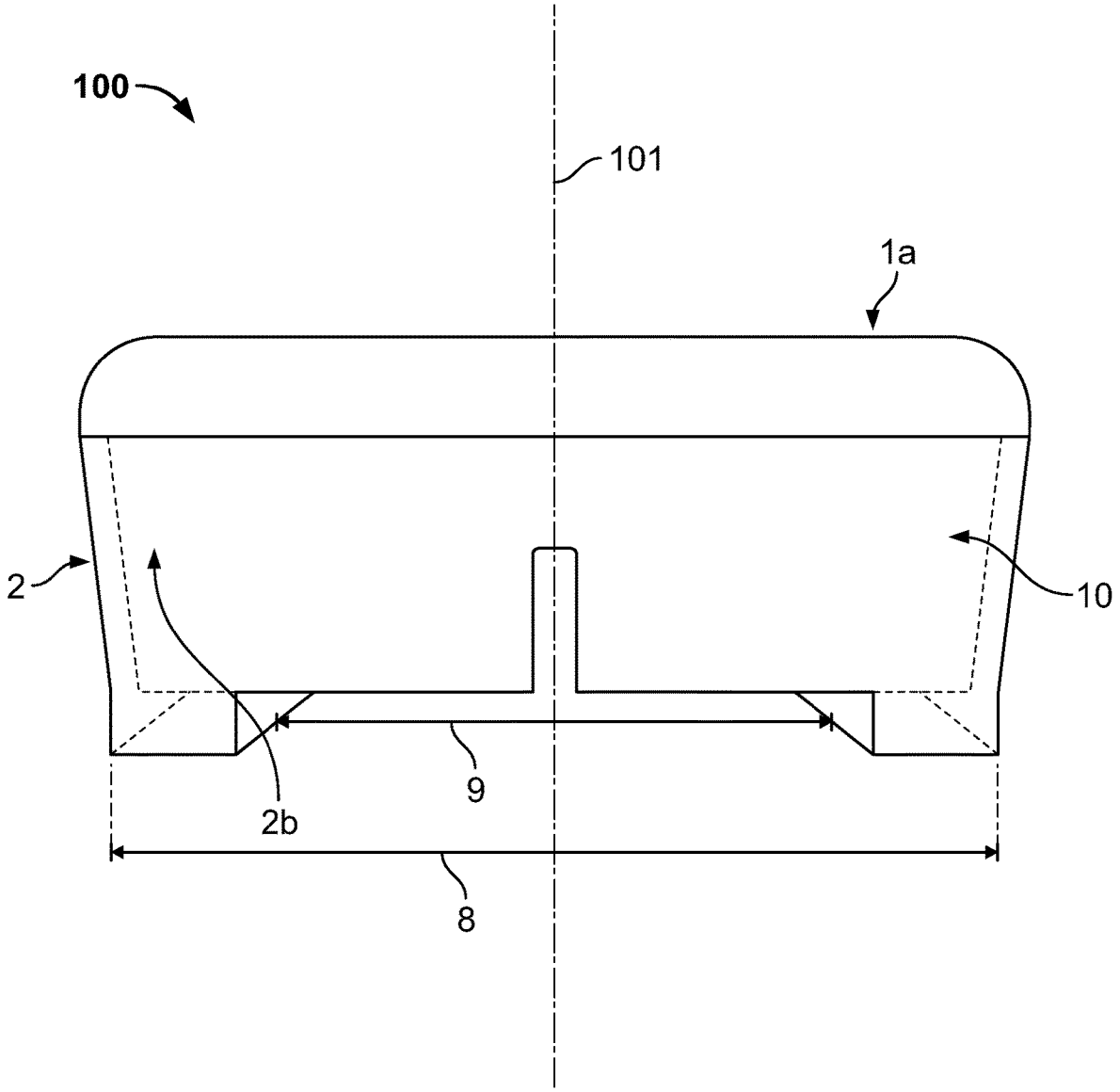
FIG. 2 is a side plane view illustrating the button cover in FIG. 1.
Figure 3:
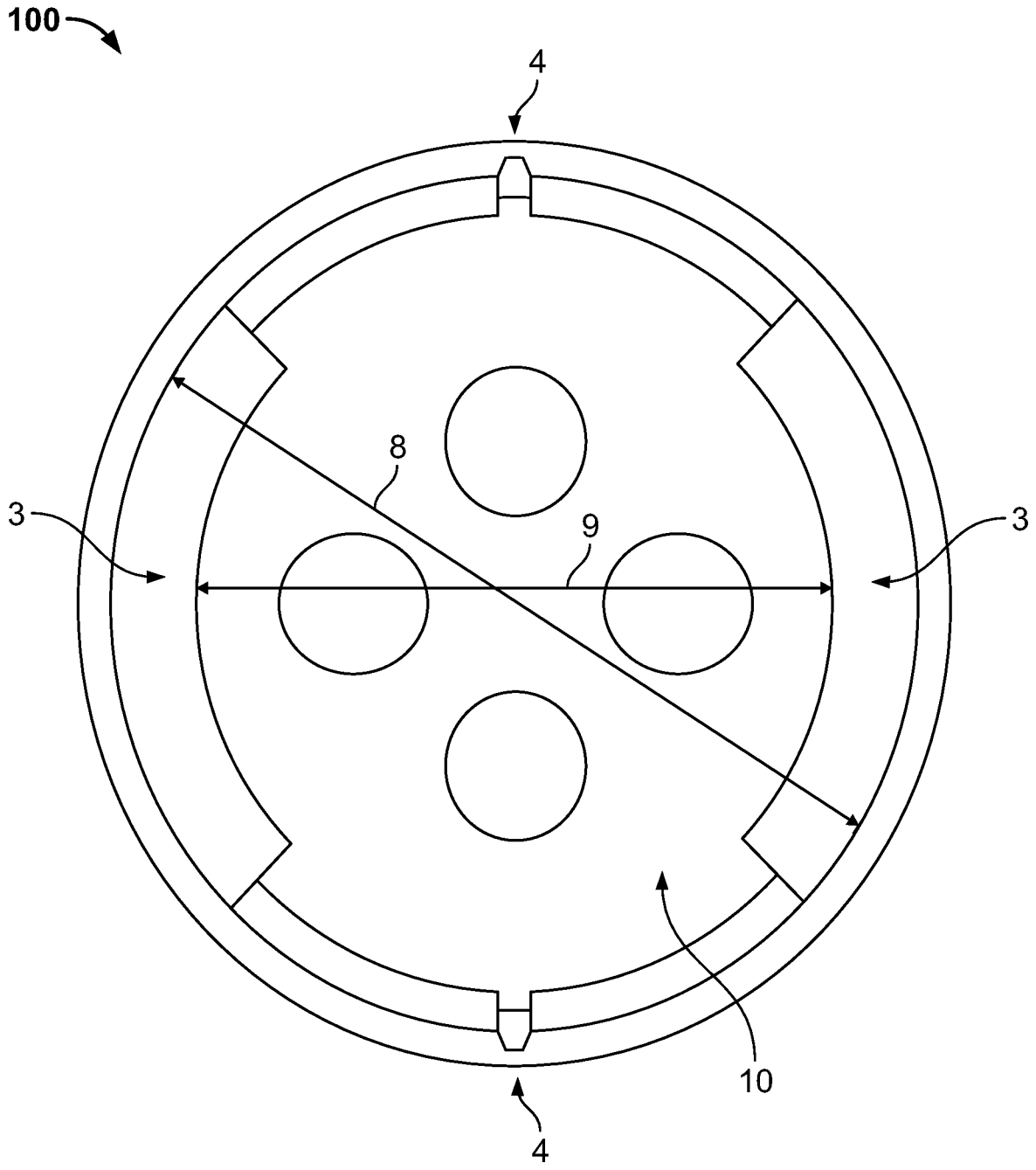
FIG. 3 is a bottom plane of the button cover in FIG. 1.
Figure 4:
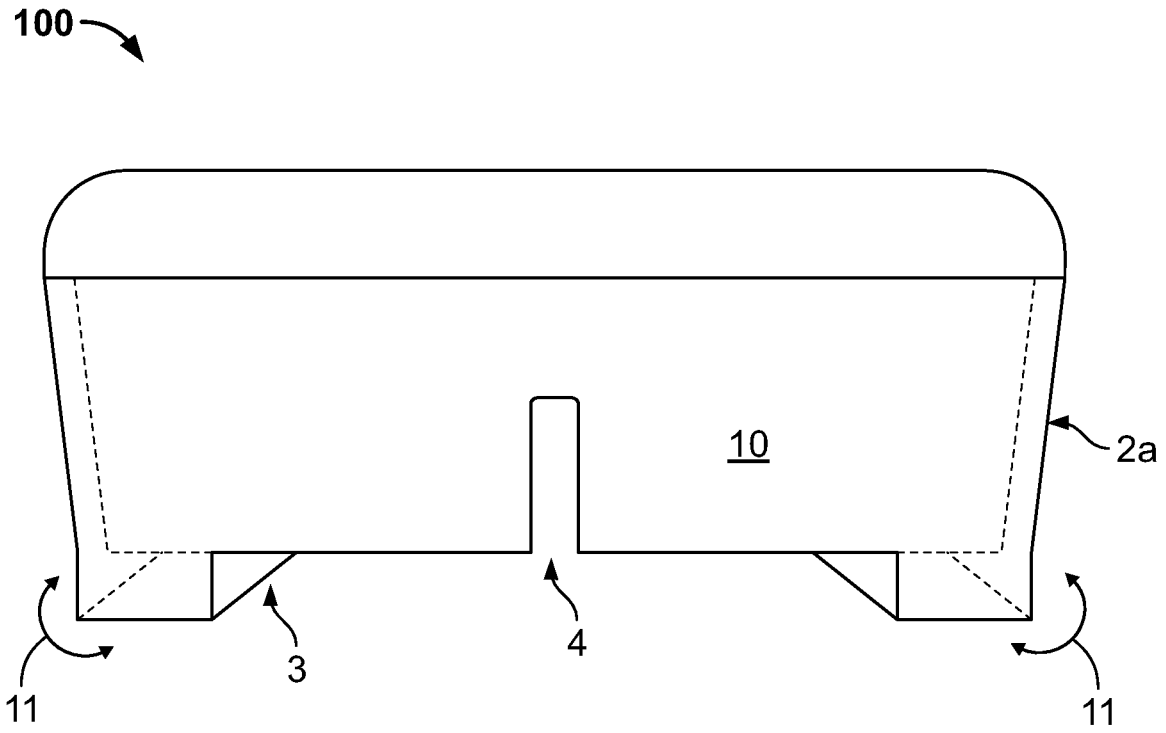
FIG. 4 is a side plane view of a button cover.

In some embodiments, the present invention is a button cover configured to removably attach to a button. A button cover of the present disclosure is illustrated in FIGS. 1-8 by button cover 100. Top cover 1 of button cover 100 has exterior face 1*a* and interior face 1*b*. As can be seen, top cover 1 is nearly radially symmetric with respect to a central axis (as shown in FIG. 2 as central axis 101). Annular wall 2 extends from the perimeter of the interior face 1*b* of the button cover. The exterior of the top cover 1*a* and exterior of the annular perimeter wall 2*a* (and any designs added to each) are typically the only features visible when the button cover is applied.

Button cover 100 comprises a cavity 10 with primary bottom opening 8 formed by the top cover 1, annular perimeter wall 2, and accompanying snaps 3. The snaps 3 are typically configured to secure a button within the cavity. The cavity 10, and how it is adapted to accommodate a button may be seen in the side plane cross section views in FIG. 6 and FIG. 7. FIG. 7 provides a side plane cross section view of a button 105 inserted into the cavity 10. The cavity is further illustrated by dotted lines in the side plane views of FIGS. 2, 4, and 5, indicating the interior features of cavity 10 as formed by top cover 1, annular perimeter wall 2, and snaps 3. When the button cover is not attached to a button, the annular wall 2 may slant inward from the perimeter of the top face (e.g., at a degree less than 90 degrees such that the diameter of the bottom opening is less than that of the top cover).

In certain implementations, two or more snaps 3 that extend from the bottom of the annular wall 2 and inward towards the major axis 101 of the button cover create a primary bottom opening diameter 8 and secondary bottom opening diameter 9. The outermost periphery of the snaps form the edge of the primary bottom opening diameter 8 which is dimensioned to allow the cover to receive a button into the cavity 10 (e.g., opening diameter 8 is from 100%-130% of the largest diameter of a button). The innermost periphery of the snaps 3 form the edge of secondary bottom opening 9 which is dimensioned to secure a button in the cavity 10. The snaps 3 may have a sloped face e.g., (an inwardly sloped face with respect to the central axis) connecting the outermost periphery defined by bottom opening diameter 8 with the innermost periphery defined by bottom opening diameter 9. Such sloped face on the snaps may provide, for an example an initial touch point for the button cover during application (e.g., it may orient the button appropriately for insertion into the cavity). These sloped surfaces may also encourage an outward force to be applied to the walls (e.g., as indicated by the outwardly pointing arrows 11). A force applied to the button cover may cause bottom opening diameter 9 to increase an amount sufficient to accommodate a button. FIG. 6 and FIG. 7 provide a profile of the snaps 3 having an exemplary sloped edge.

Two or more slits 4 may be disposed radially around the annular wall 2. In concert with the sloped edge of the snaps, these slits may allow the primary bottom opening 8 and secondary bottom opening 9 to expand (e.g., from pushing the button cover over a button during application or pinching the top face during removal of the button cover, among other actions). A force applied along central axis 101 may cause the annular wall 2 to expand away from the central axis 101, and in particular, the annular wall sections between slits 4. Once the annular wall sections have separated such that the smaller secondary bottom opening diameter 9 in the plane perpendicular to the central axis 101 is larger than the largest dimension of the button, the button 105 will be able to be inserted into the button cavity 10. The button covers as disclosed herein may also be easily removed by applying a force to induce separation of the wall at the slits when a button has been inserted. Such a force, for example, may be applied by gripping opposite ends of the cover and applying a force to top face 1*a*. Additionally, the button covers may be configured such that a compressive force applied to the button cover (e.g., pinching the button cover above two slits) may induce wall separation and allow the button cover to be removed.

The snaps may wrap a portion of the annular wall such that the sloped feature on the face of the snaps aids in engagement and positioning of the button into the button cover. In FIG. 2, which is a perspective side view, this feature may not be apparent from when viewed from the side. However, internally, or in a cross-sectional view of the button cover, the sloped face of the snaps (e.g., the diagonal dotted line in FIG. 1) leading to the internal cavity may be seen. This sloped face may be configured to orient the button cover to allow for more facile insertion of buttons into the cavity.

Figure 5:
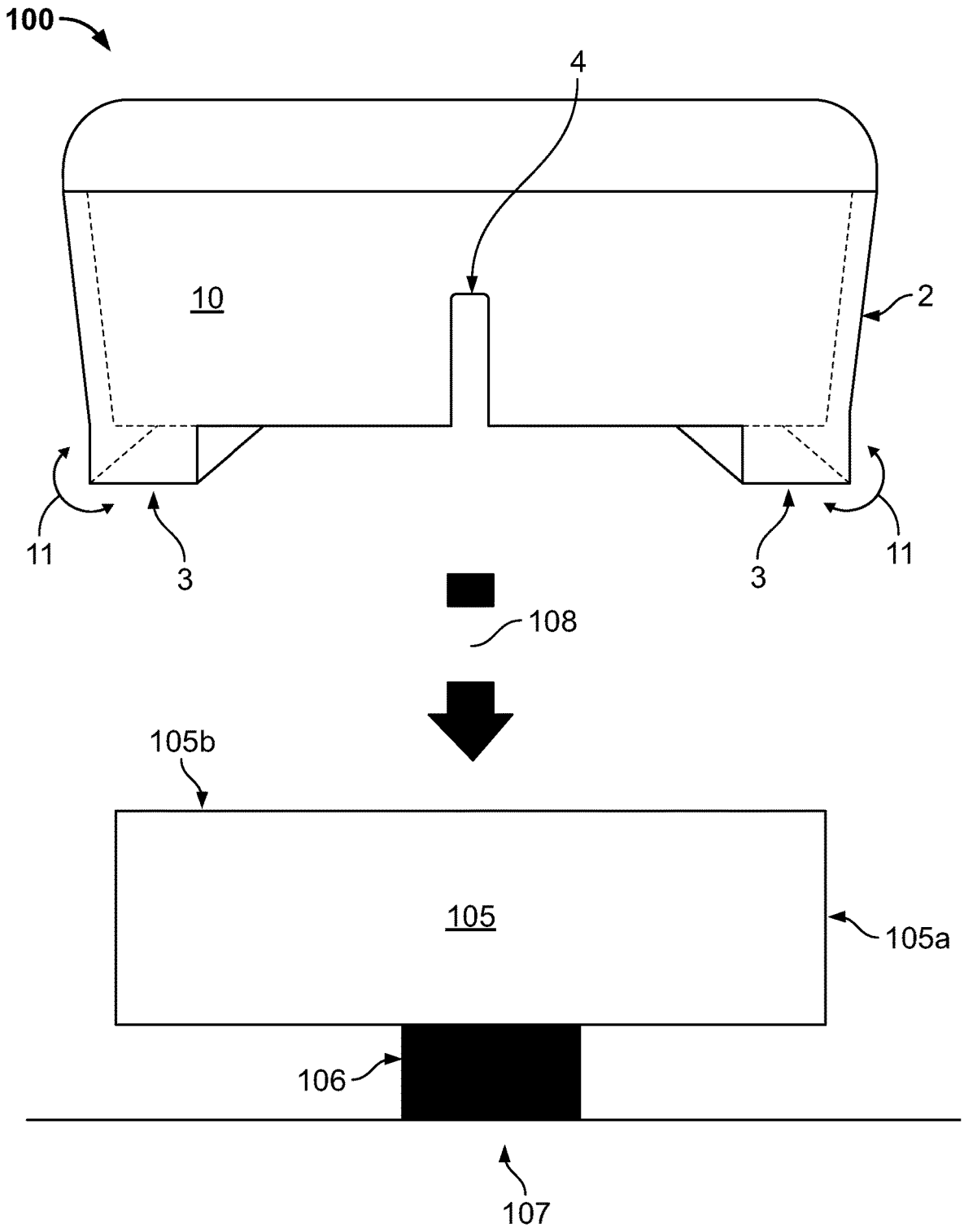
FIG. 5 is a side plane view illustrating a button cover disposed above a garment with a button attached via thread. The black arrow indicates the motion of application for covering the attached button with the present invention.
Figure 6:
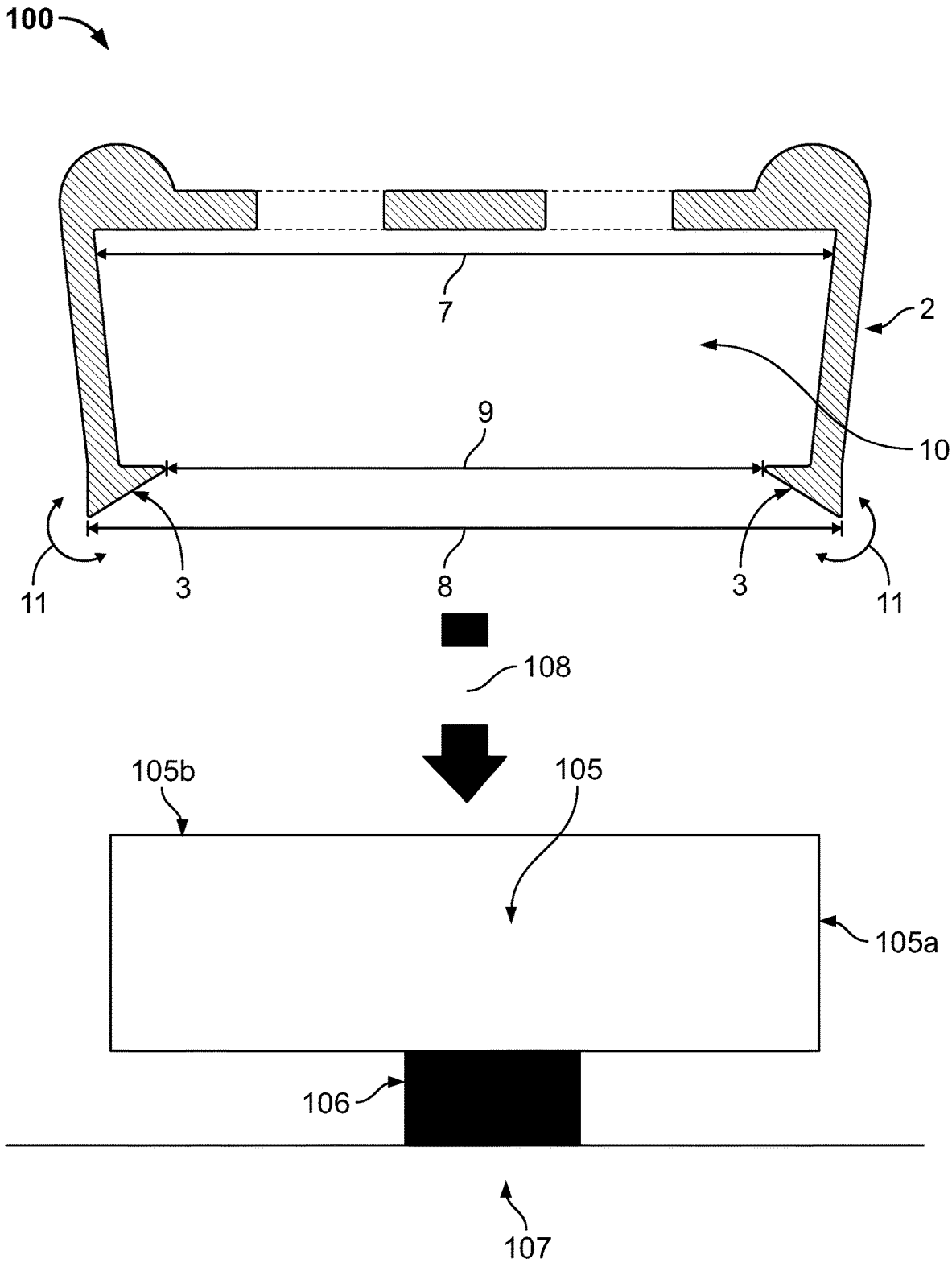
FIG. 6 is a side plane cross section view illustrating a button cover disposed above a garment with a button attached via thread. The black arrow indicates the motion of application for covering the attached button with the present invention.
Figure 7:
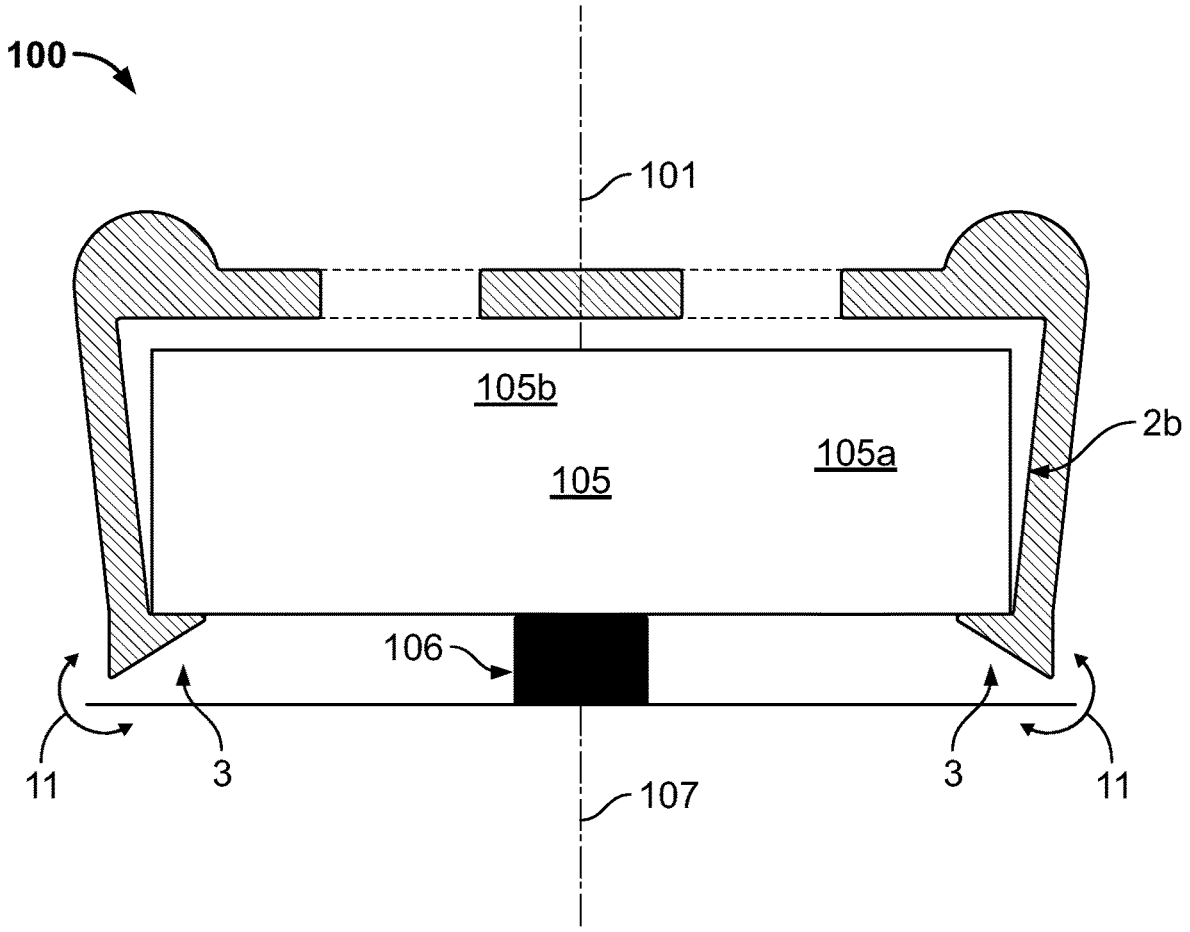
FIG. 7 is a side plane cross section view illustrating a button cover of the present disclosure accommodating a button.

FIG. 5 and FIG. 6 illustrate the application of button cover 100 to button 105 attached to a material 107 such as fabric via thread 106. Button 105 has sidewall 105*a* and top 105*b* which are dimensioned similarly to cavity 10 of button cover 100. In most cases, when the button cover is applied via force 108 as shown in FIG. 5 and FIG. 6, the bottom snaps 3 will be the first features to make contact with the button. The normal force of the button on the outermost peripheral of the inwardly sloped faces of the snaps 3 when force 108 is applied will cause the portions of perimeter wall 2 to separate at the slits 4. This separation increases the size of the primary bottom opening 8 and secondary bottom opening 9 (e.g., as indicated by the outwardly pointing arrows 11). The annular wall 2 will be forced outward from its natural state (e.g., to a degree greater than or equal to 90 degrees). The slits 4 allow this action to increase the size of the primary and secondary bottom openings 8, 9 rather than simply reshape the opening. In some embodiments, opening diameter 9 when a button is accommodated is equal to the opening diameter when a button is not accommodated. In some embodiments, opening diameter 9, when a button is accommodated, is greater than opening diameter 9 when a button is not accommodated. When the inner most periphery of the snaps 9 is greater than the periphery of the button (e.g., due to the outward action created by the button's pressure and function of the snaps), the button may be inserted.

FIG. 7 is a cross section view of the button cover in its applied state accommodating button 105. When the button entirely passes the inner most periphery of the snaps 9 the perimeter wall 2 attempts to return to its natural state (e.g., inwardly slanted at a degree less than 90 degrees) and may exert a force (e.g., a frictional force action indicated by the inwardly pointing arrows 11) on the enclosed button (e.g., in order to contact the enclosed button during application to aid the sustained attachment of the cover and allow attachment to buttons of varied sizes). Once this has occurred, the button cover is considered to be in its applied state. In the applied state,

- the top face of the snaps 3 may rest against the bottom of the button, and/or
- the inner wall 2*b* may rest against the side of the button 105*a*, and/or
- the interior of the top cover 1*b* may rests against the top of the button 105*b*, securing the cover on the button (any of which may provide a securing force for the button cover to the button.

Generally, the secondary bottom opening 9 can be expanded to remove the button from its accommodated state. The slits 4 may aid in this button and button cover disengage such that when a force is applied outwardly on the perimeter walls 2 (e.g., pinching the top face, among other actions), the walls separate sufficiently to allow the button to be removed from the cover.

Figure 8:
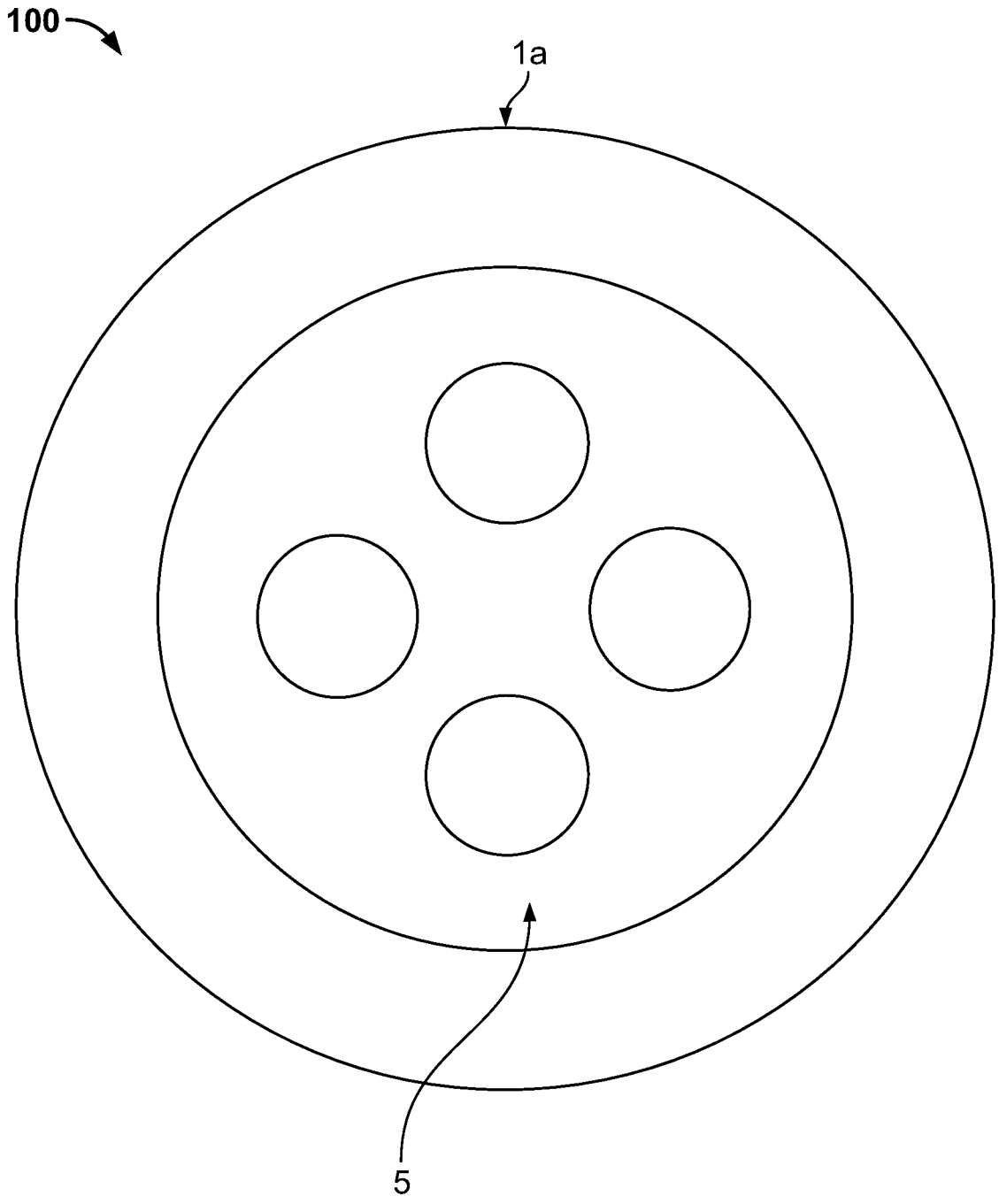
FIG. 8 is a top plane view of a button cover of the present disclosure illustrating the button cover having been applied to the button.

FIG. 8 displays a top view of the exterior top face 1*a* after button insertion in one of its forms featuring holes 5 arranged in a square in the center of the face. The top face 1*a* may comprise no holes, or one or more (e.g., two, three, four) holes connecting the top face to the button cavity in any configuration (e.g., as a design element). In some embodiments, each hole may comprise a draft of less than (or from 0.1° to) 5° or 4° or 3° or 2° or 1° (e.g., from 0.5° to 1.5°). Other embodiments of the present disclosure may include appearance elements (e.g., extruded design elements as prepared from the 3D printing) on the exterior of the button cover (e.g., to mimic the appearance of a button, to add a design element to the button such as a symbol (e.g., numbers, letters), logo, mascot (e.g., little fighting Irish guy), shape image, words, numbers), to alter the apparent shape of the top cover, to display a logo or other insignia, to create a texture, to mimic another material). In some embodiments, the button cover may have an external feature allowing for such appearance elements to be attached (e.g., the top face may have an adhesive to attach to an appearance element.

Figure 9A:
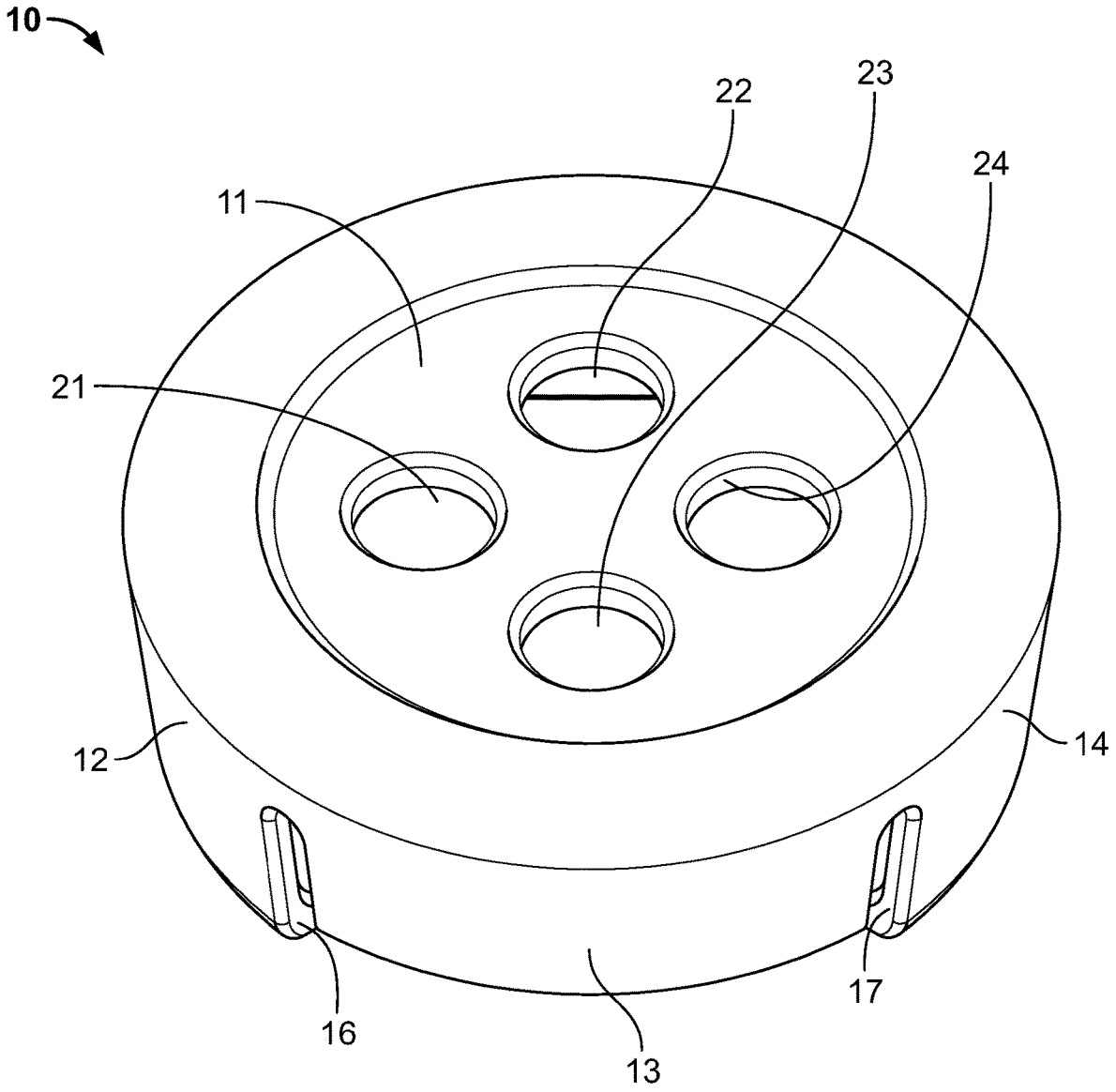
FIGS. 9A-C provide various views of a button cover of the present disclosure.
Figure 9B:
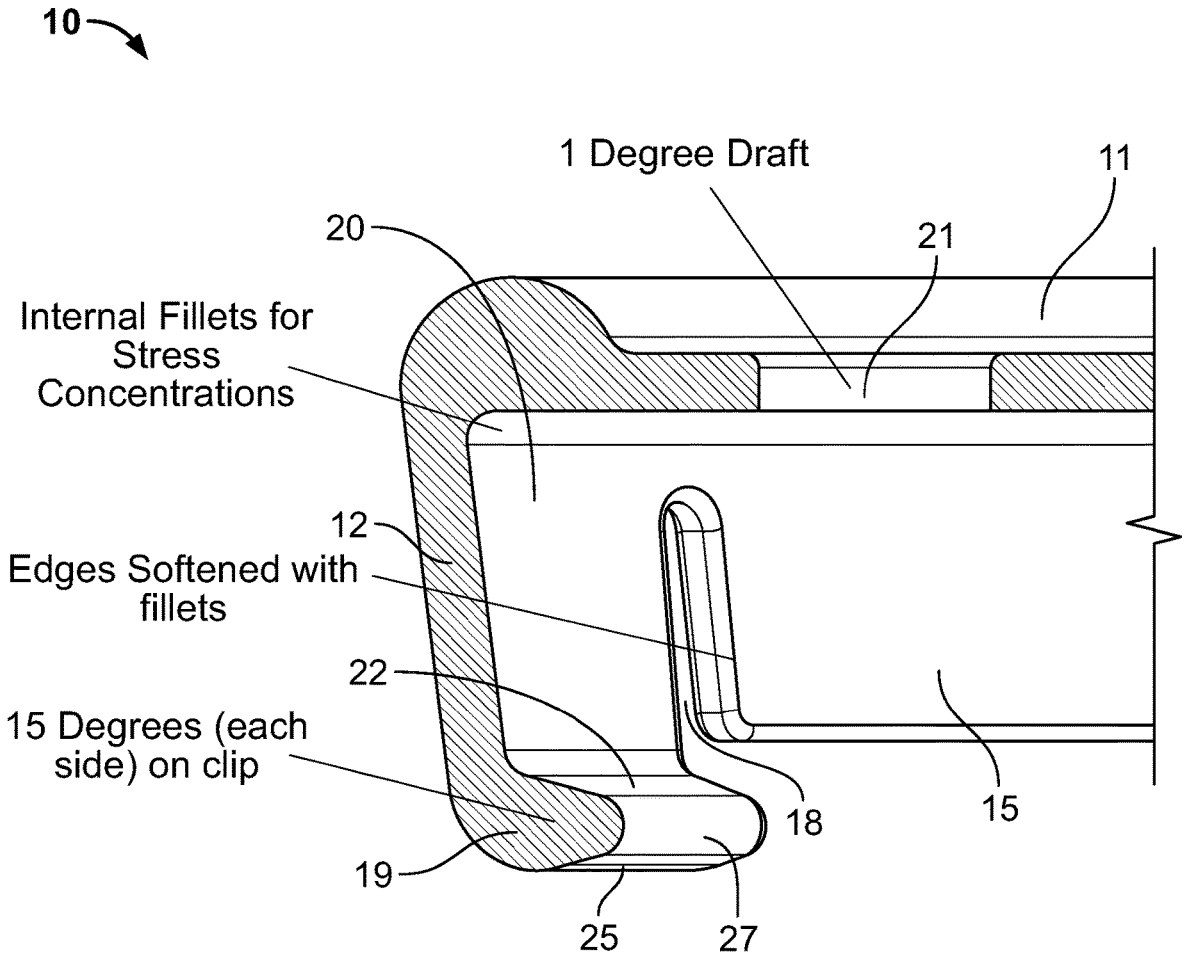
Figure 9C:
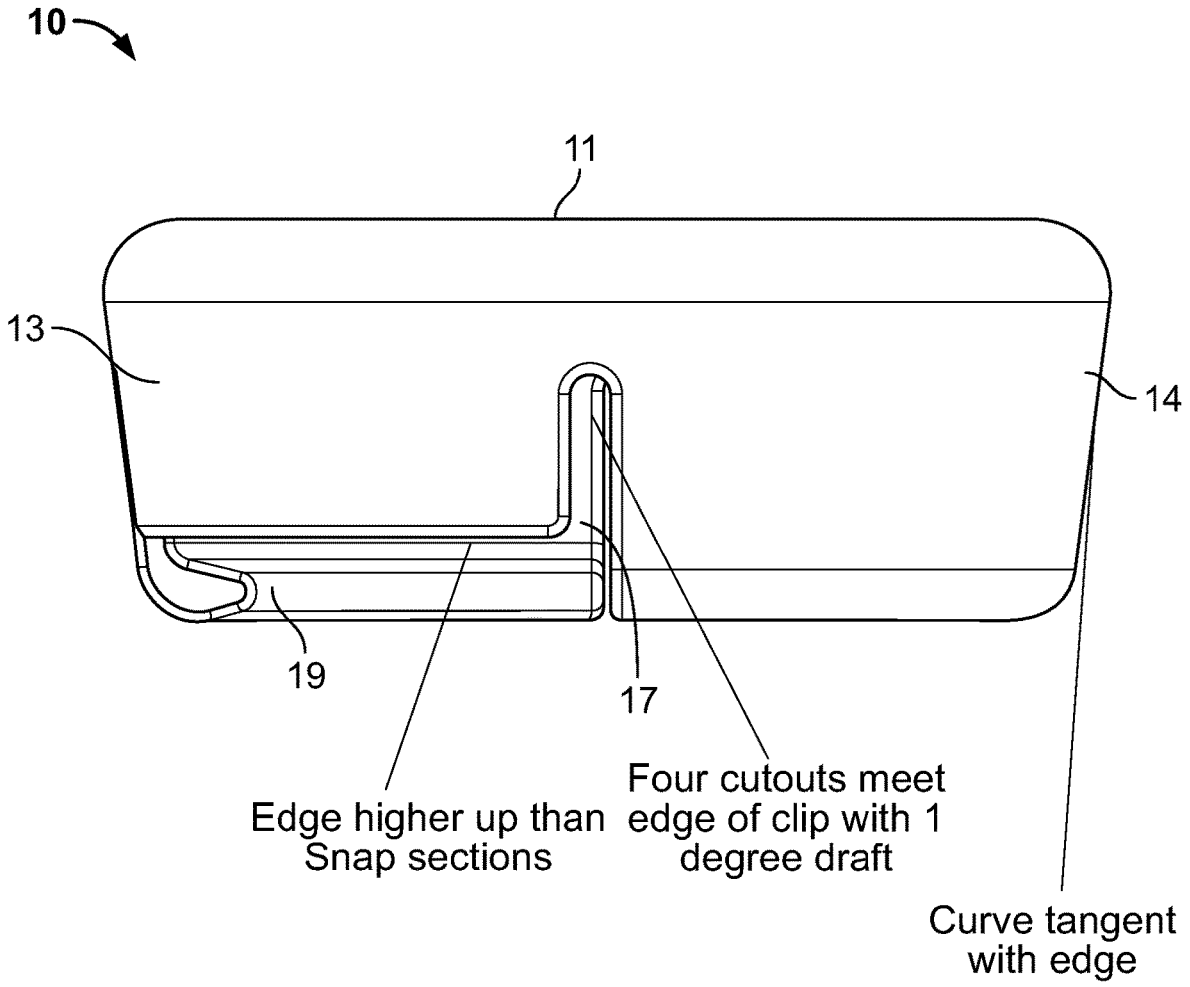

Referring now to FIG. 9A, a perspective view of button cover 10 is provided. Button cover 10 comprises top cover 11 and four slits defining annular wall sections therebetween. Button cover 10 comprises annular wall sections 12-15, four slits including slits 16-18, two snap sections including snap section 19, and holes 21-24 positioned on top cover 11. A combination cross sectional/perspective view of button cover 10 is shown in FIG. 9B depicting annular wall sections 12 and 15 and button cavity 20 and depicts internal surfaces of the snap and annular wall and top surface not seen in perspective views. A side perspective view of button cover 10 is shown in FIG. 9C depicting the external faces of annular wall sections 12, 13, and 14 as shown from an external viewpoint. The cross section in FIG. 9B is provided along the plane of symmetry of the button cover comprising axis illustrated by the dotted line in FIG. 9A.

Annular wall section 12 is between slits 16 and 18, annular wall section 13 is between slits 16 and 17, annular wall section 14 is between slit 17 and a fourth slit (not shown), and annular wall section 15 is between slits 18 and the fourth slit. Each annular wall section may independently comprise a snap section at its end distal from the tip face. In button cover 10, annular wall section 12 comprises snap section 19 formed by the intersection of internal snap face 25 and external snap face 26. In certain implementations, the button cover may comprise alternating wall sections with snaps and wall sections without snaps (e.g., a wall section with a snap is adjacent to two wall section without a snap). For example, wall sections 12 and 14 may comprise a snap and wall sections 13 and 15 may not comprise a snap. In the embodiment depicted, wall section 12 has snap 19 at the end distal from the top face. The snap comprises internal snap face 22 and external snap face 25. These faces comprise planar non-parallel surfaces which intersect at a rounded edge 27 to form snap 19. As can be seen, the snap may be formed by the intersection of two non-parallel planar surfaces (e.g., the cross section of each snap face is linear), wherein the internal surface of snap is sloped away from the top surface of the internal cavity, and the exterior surface is sloped toward the top surface of the internal cavity.

As shown in FIG. 9B, both the interior and exterior surface of annular wall section 12 is angled inwardly. In the embodiment depicted, annular wall 12 has an angle less than 90° with respect to the top surface. During insertion of a button, force applied from the button to external snap face 25 may be cause annular wall 12 (and optionally annular wall 14) to move outwardly until the sections are moved enough for the button to pass the snaps and be inserted into button cavity 20. Similarly, force applied the angled internal snap face 22 during removal may cause an outward expansion of annular wall 12 (and optionally annular wall 14) until one or both annular wall section is moved sufficiently such that the button may pass the snaps. Annular wall sections 13 and 15 do not comprise a snap section. During insertion and removal of the button, may not move or necessary to move in order to accommodate the button to be inserted or removed from button cavity 20. For example, the annular wall sections not comprising a snap may be formed such that only the frictional force is applied from sections comprising a snap. The height of annular wall section 15 is similar to the height of annular wall section 14 before snap 22.

Button cover 10 depicted in FIGS. 9A, 9B, and 9C comprises fillets between the annular walls and the top cover, fillets in the slits, and fillets in the annular wall sections which do not comprise a snap. As can be seen in FIG. 9B, the button holes comprise a 1° draft, the internal connection between the annular wall and the top cover comprises internal fillets for stress concentrations, the edges are softened with fillets, and the snap comprises sloped faces with 15° on each side to form sloped annular snap surface (angle with respect to the horizontal axis of the interior portion of the top surface which is parallel with wall sections not comprising a snap section). As can be seen in FIG. 9C, wall sections without a snap may be positioned higher up (or close have a height smaller than) wall sections and snaps. Additionally, the slits (or cutouts) may meet the edge of each snap (or clip) with a draft such as a 1° draft. The external surface of the annular wall may be connected to the top surface via a curve tangent with each edge.

Figure 10:
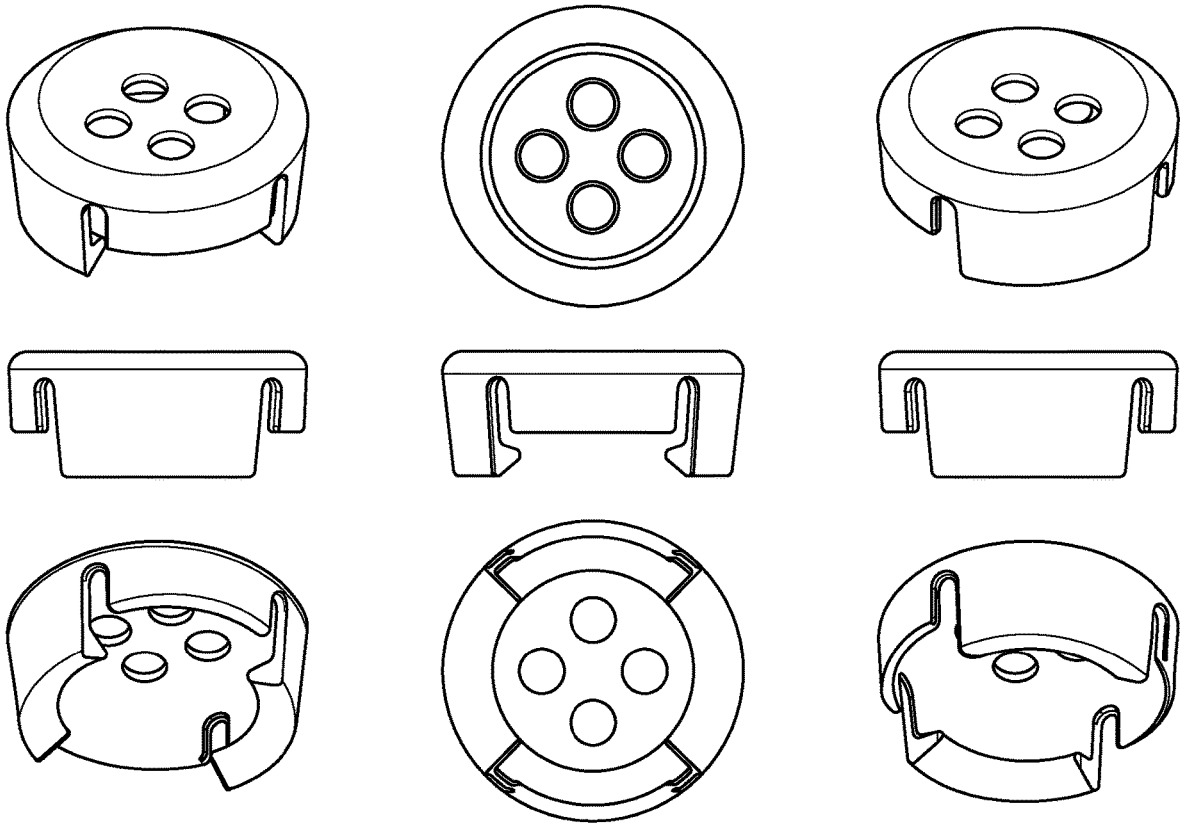
FIG. 10 provides several views of a button cover of the present disclosure.

Several perspective views of a similar button cover to those depicted in FIGS. 9A-9C may be found in FIG. 10, showing perspectives from the top (top row), side (middle row), and bottom (bottom row). As can be seen, the slits are distributed nearly symmetrically around the top face with snaps only present on alternating wall sections. As can be seen, the annular wall sections on opposing annular wall sections without a snap for a single opening dimension for insertion of a button into the cavity, while opposing annular wall sections with a snap comprise both a primary and secondary opening dimension. In some embodiments, the single opening dimension formed between opposing wall sections without a snap is approximately equal (e.g., within 1 mm) to the primary opening dimension of the opposing wall sections with a snap.

Buttons to which the button cover can be applied generally have a volume similar to (e.g., within about 10% or 5%), equal to, or less than the volume of the inner cavity of the button cover. For example, the button may have a depth (or height) equal to or less than the depth of the button cover's cavity 10 and a diameter less than distance between the annular wall on the inner face 7 but greater than the diameter of the secondary bottom opening 9. In the button cover's common form one or more of the following may apply:

i) the exterior face (e.g., exterior face 1*a*) has a diameter of from 10 to 15 mm (e.g., from 10.6 mm to 14.6 mm, from 12-13 mm, from 12-14 mm, 12.6 mm, 13.09 mm)

ii) the interior face (e.g., interior face 1*b*) enclosed by the annular wall that extrudes from the bottom plane of the face has a diameter of from 9 to 13 mm (e.g., from 10 to 12.1 mm from 11 to 12.1 mm, from 10.6 mm to 12.6 mm, 11.6 mm, 12.03 mm), iii) the annular wall (e.g., annular wall 2) extends downward from 1 to 5 mm (e.g., from 2-4 mm, from 2.3 mm to 4.3 mm, 3.3 mm, 3.45 mm) from the bottom plane of the top surface face and inward at an angle of from 75°-90° (e.g., 80°-85°, 83°, 82-83°, 82.85°) to create the internal cavity (e.g., internal cavity 10), iv) each snap (e.g., snap 3, trapezoidal snaps, trigonal snaps, two planar surfaces connected by, for example, a rounded point) at the bottom of the annular wall is less than (or from 0.1 mm to) 2 mm, 1.5 mm, 1.2 mm, 1.1 mm, or 1 mm (e.g., from 0.5 mm to 1.1 mm, 1-1.1 mm, 0.7 mm) in length as measured downward from the bottom plane of the annular wall to the outer edge of the snaps, v) each snap (e.g., snap 3, trapezoidal snaps, trigonal snaps, two planar surfaces connected by, for example, a rounded point) at the bottom of the annular wall is from 1 mm to 2 mm (e.g., from 1 mm to 1.5 mm, from 1.5 mm to 2 mm, 1.2 mm, from 1.5 mm to 1.8 mm, from 1.7 mm to 1.8 mm) in width as measured inward from the exterior of the annular wall toward (and perpendicular to) the major axis of the button cover, vi) each snap (e.g., snap 3, trapezoidal snaps, trigonal snaps, two planar surfaces connected by, for example, a rounded point) at the bottom of the annular wall has an angled surface that is sloped inward towards the central cavity of the button cover, vii) the primary bottom opening (e.g., primary bottom opening 8) formed by the outermost periphery of the snaps has a diameter of from 5 to 15 mm (e.g., from 9 to 14 mm, from 9 mm to 10 mm, from 9.7 mm to 13.7 mm, from 10 mm to 14 mm, from 11 mm to 12 mm, 11.7 mm), viii) the secondary bottom opening (e.g., secondary bottom opening 9) formed by the innermost periphery of the snaps has a diameter of from 7 to 12 mm (e.g., from 7.4 mm to 11.4 mm, from 8 to 10 mm, 9.4 mm, from 9 to 9.2 mm), ix) each slit (e.g., slit 4) is independently less than (or from 0.1 mm to) 10 mm (e.g., less than 8 mm, less than 6 mm, less than 5 mm) in width from the annular wall as measured on a plane horizontal to the interior face of the top surface (e.g., half the distance between the primary and secondary openings) and optionally extends from the bottom plane of the annular wall a distance of from 0.5 mm to 3 mm (e.g., 1 mm to 3 mm, from 1.9 mm to 2.9 mm, 1.9 mm);

x) any snap face oriented towards the button when the button is inserted into the internal cavity (i.e., an internal snap face) may be independently (with respect to each snap section on an annular wall) greater than or equal to 90° with respect to a plane perpendicular to the cross sectional axis of the interior cavity face (e.g., from 90° to 150° from 90° to 120°, from 100° to 115°);

xi) any snap face oriented away from the button when the button is inserted into the internal cavity (i.e., an external snap face) may be independently (with respect to each snap section on an annular wall) less than or equal to 90° with respect to a plane perpendicular to the cross sectional axis of the interior cavity face (e.g., from 30° to 90° from 60° to 90°, from 70° to 80°);

xii) the annular wall may have an internal cavity height is typically less than the annular wall height and may be, for example, from 1 to 5 mm (e.g., from 2-4 mm, from 2.3 mm to 4.3 mm, 3.3 mm, 3 mm to 3.1 mm, 3.06 mm, 3.45 mm).

Figure 11:
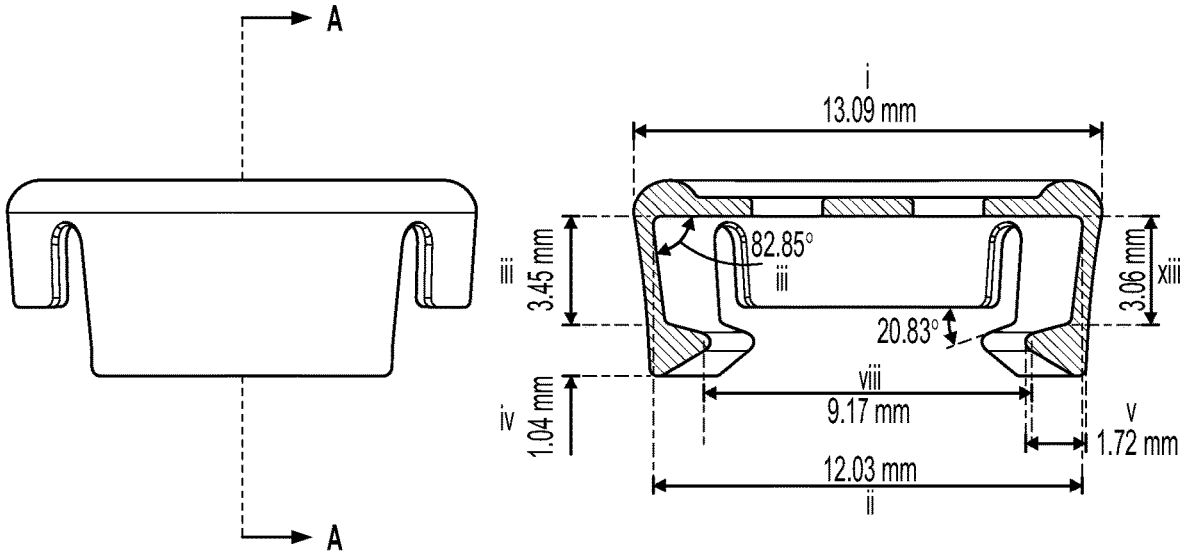
FIG. 11 illustrates a cross sectional view, along plane A of a button cover of the present disclosure. The greyed areas indicate those portions in plane A, while the uncolored regions are portions of the button cover not in plane A.

FIG. 11 provides exemplary cross sectional measurements in plane A of a button cover of the present disclosure. Various dimensions from i)-xi) are illustrated in FIG. 11 without. Although the embodiment depicted provides specific measurements, it will be understood that any appropriate dimension range of the present disclosure, or combinations thereof, is embraced by the button covers of the present disclosure. Additionally, some dimensions in FIG. 11 may be used to correlate with those described above. For example, FIG. 11 depicts an angle (20.83°) of the external snap face with respect to a plane parallel to the cross-sectional axis of the interior cavity face, while descriptions above recite similar angles in terms of a plane perpendicular to the cross sectional axis of the interior cavity face.

In its common form each button cover is a unitary part made of one or more plastics. Suitable plastics include polypropylene, polyethylene, thermoplastic polyurethane, thermoplastic rubber, thermoplastic elastomer, nylon (polyamide), acrylic, polycarbonate, polyoxymethylene, polystyrene, acrylonitrile butadiene styrene, or polyphenylsulfone, among others.

Suitable production methods include injection molding, compression molding, and/or 3-dimensional (3D) printing.

The mold used in either production method features a single cavity per button cover. The simple production method is allowed by the unique design of the invention.

As various changes can be made in the above-described subject matter without departing from the scope and spirit of the present disclosure, it is intended that all subject matter contained in the above description, or defined in the appended claims, be interpreted as descriptive and illustrative of the present disclosure. Many modifications and variations of the present disclosure are possible in light of the above teachings. Accordingly, the present description is intended to embrace all such alternatives, modifications and variances which fall within the scope of the appended claims.

The invention claimed is:

1. A button cover configured to removably attach to a button comprising:

a top cover of minimal thickness;

a bottom opening having dimensions that permit to be inserted through in order to attach the button; wherein the bottom opening is formed from an annular wall extending from the perimeter of the bottom face of the cover;

wherein when the button cover is not attached to a button, the annular wall slants inward from the perimeter of the top face; and when the button cover is attached to a button, the wall exerts a force on the enclosed button;

wherein the wall comprises:

a) two or more slits disposed radially around the wall configured to allow the bottom opening to expand upon insertion of the button;

b) two or more bottom snaps extending from the bottom of the wall and inward towards the major axis of the button cover; wherein the two or more snaps comprises a inwardly sloped face; such that the outermost peripheral of all of the sloped faces is dimensioned to provide an initial touch point for the button cover during application to a button;

wherein a force applied from the button to the snaps during application of the button causes the walls to separate at the slits, and when the inner most periphery of the snaps is greater than the periphery of the button, the button may be inserted such that the bottom face of the cover is in contact with the top face of the button and the walls are oriented against the inserted button to provide the force on the inserted button.

2. The button cover of claim 1 wherein the button cover is a unitary piece of material manufactured by way of plastic injection molding from a single mold cavity.

3. The button cover of claim 1 wherein the top cover comprises an appearance modifying feature.

4. The button cover of claim 3, wherein the appearance modifying feature is added to the button cover using without the use of plastic injection molding.

5. The button cover of claim 3, wherein the button cover is manufactured by plastic injection molding from a single mold cavity, and the appearance modifying feature is extruded.

6. The button cover of claim 1 wherein the top face comprises two or more holes.

7. The button cover of claim 6, wherein the top face comprises four holes arranged in a square pattern.

8. The button cover of claim 1, wherein the top cover of the top face is ovular, rectangular, rhombus-shaped, diamond shaped, triangular, circular, hexagonal, octagonal, parallelepiped.

9. An apparatus for attaching to a piece of fabric comprising a button and a button cover, wherein the button cover is configured to removably attach to the button and the button cover comprises:

a top cover of minimal thickness;

a bottom opening having dimensions that permit to be inserted through in order to attach the button; wherein the bottom opening is formed from an annular wall extending from the perimeter of the bottom face of the cover;

wherein when the button cover is not attached to a button, the annular wall slants inward from the perimeter of the top face; and when the button cover is attached to a button, the wall exerts a force on the enclosed button;

wherein the wall comprises:

a) two or more slits disposed radially around the wall configured to allow the bottom opening to expand upon insertion of the button;

b) two or more bottom snaps extending from the bottom of the wall and inward towards the major axis of the button cover; wherein the two or more snaps comprises an inwardly sloped face; such that the outermost peripheral of all of the sloped faces is dimensioned to provide an initial touch point for the button cover during application to a button;

wherein a force applied from the button to the snaps during application of the button causes the walls to separate at the slits, and when the inner most periphery of the snaps is greater than the periphery of the button, the button may be inserted such that the bottom face of the cover is in contact with the top face of the button and the walls are oriented against the inserted button to provide the force on the inserted button.

10. The apparatus of claim 9, wherein the top face of the button cover has a different shape than the top face of the button.

11. The apparatus of claim 9, wherein the top cover of the top face of the button cover is ovular, rectangular, rhombus-shaped, diamond shaped, triangular, circular, hexagonal, octagonal, parallelepiped.

12. The button cover according to claim 1, wherein the button cover is a unitary piece of material manufactured by way of plastic injection molding from a single mold cavity.

13. The button cover according to claim 1, wherein the top cover comprises an appearance modifying feature.

14. The button cover or apparatus of claim 13, wherein the appearance modifying feature is added to the button cover using without the use of plastic injection molding.

15. The button cover or apparatus of claim 13, wherein the button cover is manufactured by plastic injection molding from a single mold cavity, and the appearance modifying feature is extruded.

16. The button cover according to claim 1, wherein the top face comprises two or more holes.

17. The button cover or apparatus of claim 16, wherein the top face comprises four holes arranged in a square pattern.

* * * * *